US006210177B1

(12) United States Patent
Huang et al.

(10) Patent No.: US 6,210,177 B1
(45) Date of Patent: Apr. 3, 2001

(54) ELECTRICAL CONNECTOR

(75) Inventors: Guan-Fu Huang; Evons Chang, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/467,140

(22) Filed: Dec. 10, 1999

(30) Foreign Application Priority Data

Oct. 21, 1999 (TW) ..... 088217917

(51) Int. Cl.[7] ..... H01R 12/00
(52) U.S. Cl. ..... 439/74; 439/637
(58) Field of Search ..... 439/83, 660, 74, 439/692, 696

(56) References Cited

U.S. PATENT DOCUMENTS 5,057,027 * 10/1991 Yamada et al. ..... 439/83
5,277,597 * 1/1994 Masami et al. ..... 439/83
5,626,500 * 5/1997 Yoshimura ..... 439/74
5,667,393 * 9/1997 Grabbe et al. ..... 439/83
5,746,622 * 5/1998 Consoli et al. ..... 439/181

* cited by examiner

*Primary Examiner*—Tulsidas Patel
(74) *Attorney, Agent, or Firm*—Wei Te Chung

(57) ABSTRACT

An electrical connector comprises an insulative housing and a plurality of terminals. The insulative housing includes a central portion, a pair of side walls and a pair of lateral walls. The central portion defines a plurality of passageways therethrough for receiving corresponding terminals therein. Each terminal comprises a fixing portion, a contacting portion, a slanting portion and a tail portion. The contacting portion is formed at the top end for electrically contacting with a mating connector. The slanting portion slantways extends from the fixing portion with an obtuse angle. A tail portion is formed at the end of the slanting portion. A soldering portion of each terminal is folded at a same plane before soldering on a circuit board. Therefore, after the terminals are assembled to the insulative housing, the soldering portions of corresponding terminals can be arranged with a proper planarity and the quality of solder process is also improved.

9 Claims, 5 Drawing Sheets

ELECTRICAL CONNECTOR

BACKGROUND OF THE INVENTION

The present invention relates to a board-to-board electrical connector, and particularly to an electrical connector for signal transmission between different circuit boards.

U.S. Pat. Nos. 5,277,597, and Taiwan Patent Application Nos. 86202873, 86206353 each disclose a conventional board-to-board-to-board electrical connector. Referring to FIGS. 1A and 1B, a conventional board-to-board electrical connector 3 comprises an insulative housing 4 and a plurality of terminals 5. The insulative housing 4 includes a pair of side walls 41, 42 which are parallel to each other. A central portion 43 is disposed between the side walls 41, 42. A plurality of passageways 46 is exposed on opposite surfaces of the central portion 43 and the passageways 46 are equally distanced from each other by spacing boards (not shown). The terminals 5 are received in corresponding passageways 46 and each terminal 5 comprises a fixing portion 51, a contacting portion 52 and a soldering portion 53. The contacting portion 52 and the soldering portion 53 are respectively formed at opposite ends of the fixing portion 51. After the terminal 5 is assembled in the insulative housing 4, the soldering portion 53 is folded with right angle to solder on a circuit board (not shown). A plurality of barbs 55 is formed on opposites edges for engaging with the spacing boards for securing in the insulative housing 4.

However, the terminals 5 are assembled to the insulative housing 4 just through engagement between the barbs 55 and the spacing boards. This engagement is not reliable while an external force is exerted on the soldering portion 53 of each terminal 5. Under the external force the terminals 5 will be buckled inwardly. Furthermore, the soldering portion 53 is folded after the terminals 5 assembled to the insulative housing 4, thus, an additional tool is needed and planarity of the soldering portions 53 can not be properly controlled either.

BRIEF SUMMARY OF THE INVENTION

A main object of the present invention is to provide an electrical connector having an insulative housing and a plurality of terminals, each terminal being formed with a reliable structure for easily assembling and positioning the terminal to the housing.

To fulfill the above-mentioned object, according to a preferred embodiment of the present invention, an electrical connector comprises an insulative housing and a plurality of terminals. The insulative housing includes a central portion, a pair of side walls formed on opposite sides of the central portion, a pair of lateral walls formed on lateral sides of the central portion. The central portion and the side walls together define a receiving space for facilitating the process of assembling terminals to the insulative housing. The central portion defines a plurality of passageways therethrough for receiving corresponding terminals therein. The passageways are spaced from each other by corresponding spacing boards. Each terminal comprises a fixing portion, a contacting portion, a slanting portion and a tail portion. The contacting portion is formed at the top end thereof for electrically contacting with a mating connector. The slanting portion slantways extends from the fixing portion with an obtuse angle for dispersing an insertion force exerted thereon. A tail portion is formed at the end of the slanting portion with a pair of engaging portions formed at lateral edges thereof, the engaging portions being securely received in corresponding T-shaped slots. A soldering portion of each terminal is folded at a same plane before soldering on a circuit board. Therefore, after the terminals are assembled to the insulative housing, the soldering portions of corresponding terminals can be arranged with a proper planarity and the quality of solder process is also improved.

Other objects, advantages and novel features of the invention will become more apparent from the following detailed description when taken in conjunction with the accompanying drawings.

DETAILED DESCRIPTION OF THE INVENTION

Figure 1B:
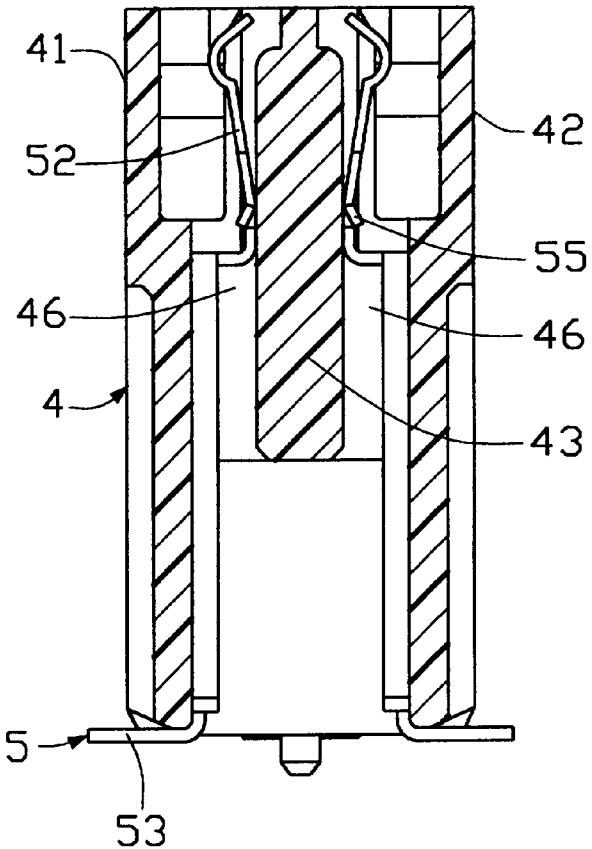
FIG. 1B (PRIOR ART)
FIG. 1B is a cross-sectional view of a conventional electrical connector.
Figure 1A:
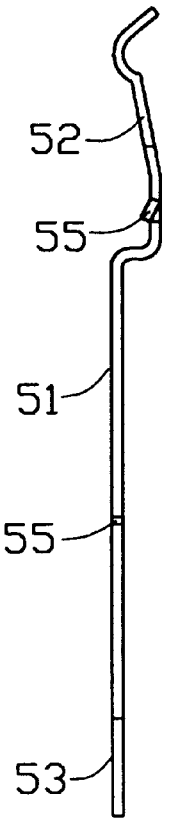
FIG. 1A (PRIOR ART)
FIG. 1A is a side view of a conventional terminal.
Figure 2:
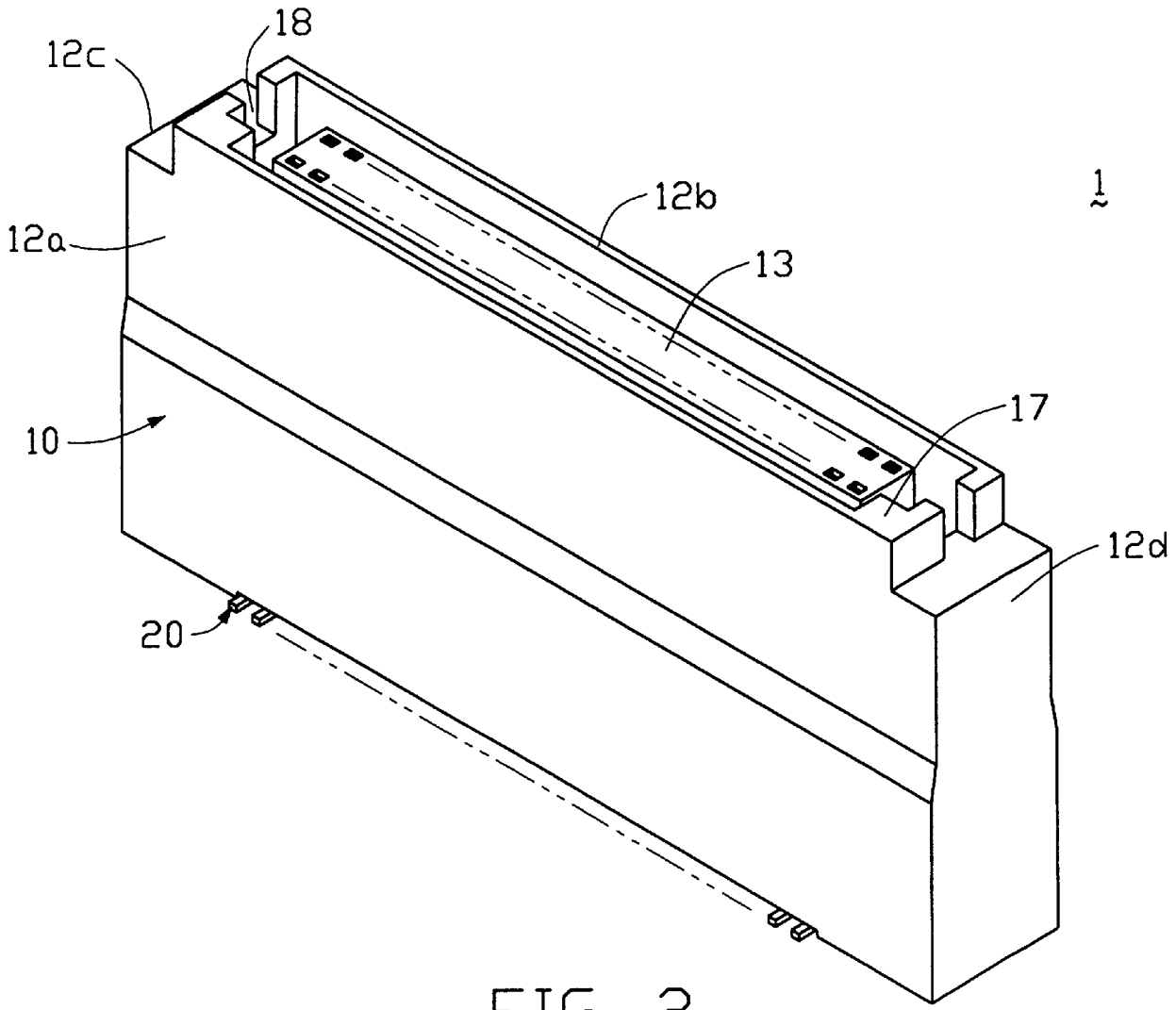
FIG. 2 is a perspective view of an electrical connector in accordance the present invention.
Figure 3:
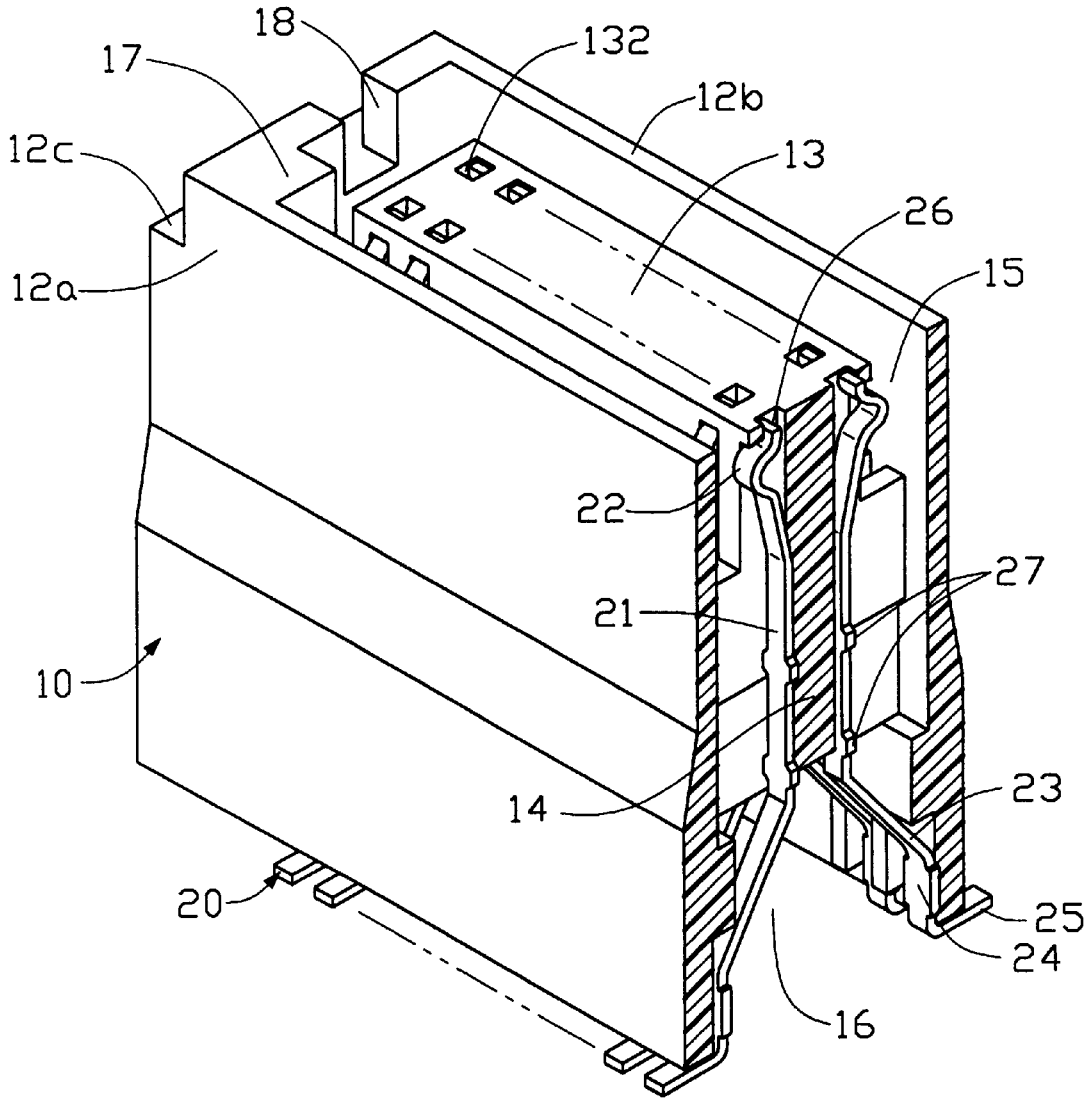
FIG. 3 is a perspective, cross-sectional view of the electrical connector.

Referring to FIGS. 2 and 3, an electrical connector 1 comprises an insulative housing 10 and a plurality of terminals 20. The insulative housing 10 includes a central portion 14, a pair of side walls 12*a*, 12*b* formed on opposite sides of the central portion 14, a pair of lateral walls 12*c*, 12*d* formed on lateral sides of the central portion 14. A mating face 13 is formed at the top face of the central portion 14 for mating with an external connector. A pair of mating slots 15 is defined between the central portion 14 and the side walls 12*a*, 12*b* respectively. The central portion 14 and the side walls 12*a*, 12*b* together define a receiving space 16 for facilitating the process of assembling terminals 20 to the insulative housing 10. A pair of stepped portions 17 is respectively formed at the top end of corresponding side walls 12*a*, 12*b*, and a pair of cutouts 18 is respectively formed at lateral ends of the stepped portions 17. The stepped portions 17 and the cutouts 18 are used for avoiding mistake assembly while the present connector is assembled with another connector.

Figure 4:
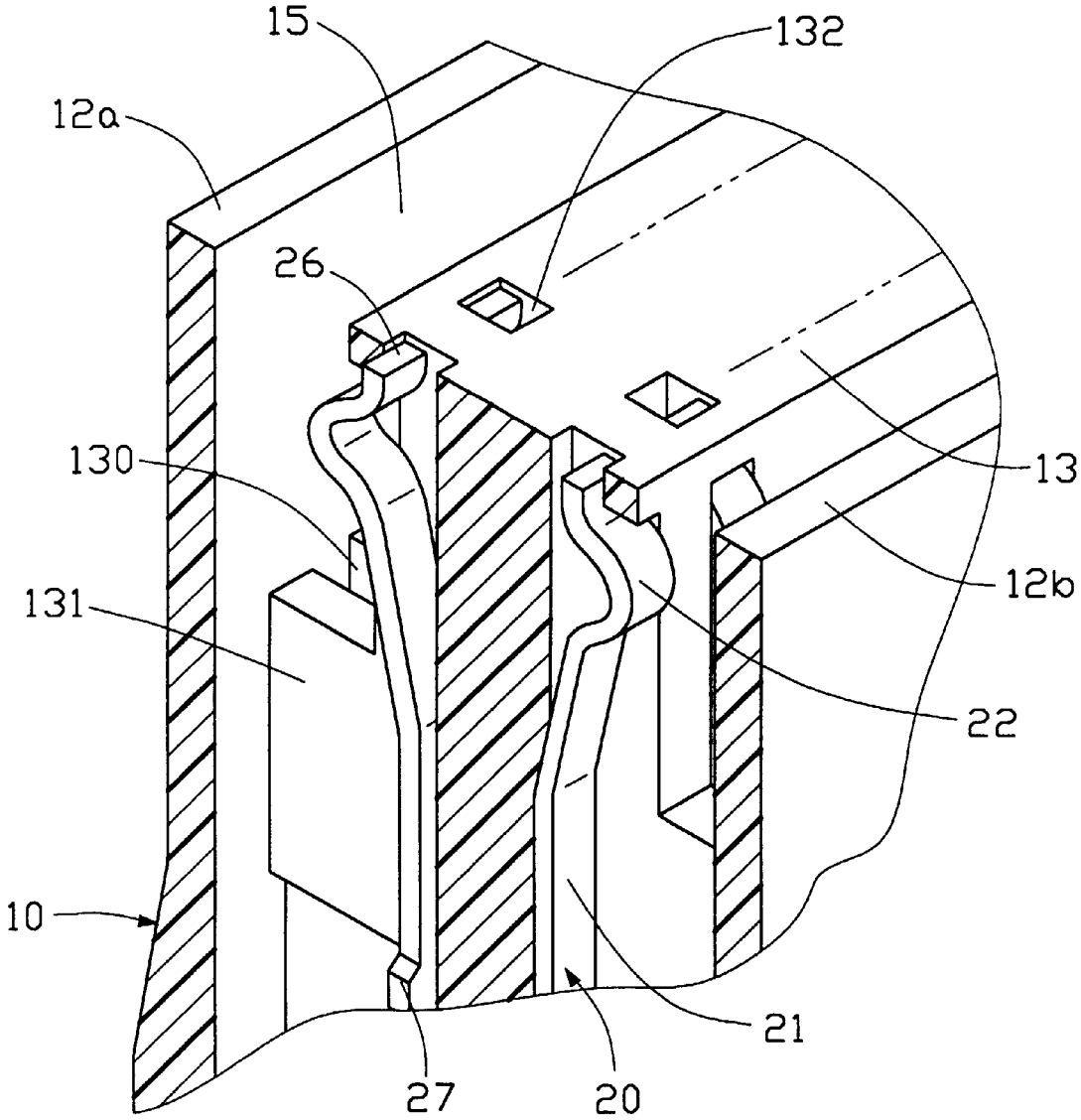
FIG. 4 is a partial, enlarged view of an upper portion of FIG. 3.
Figure 5:
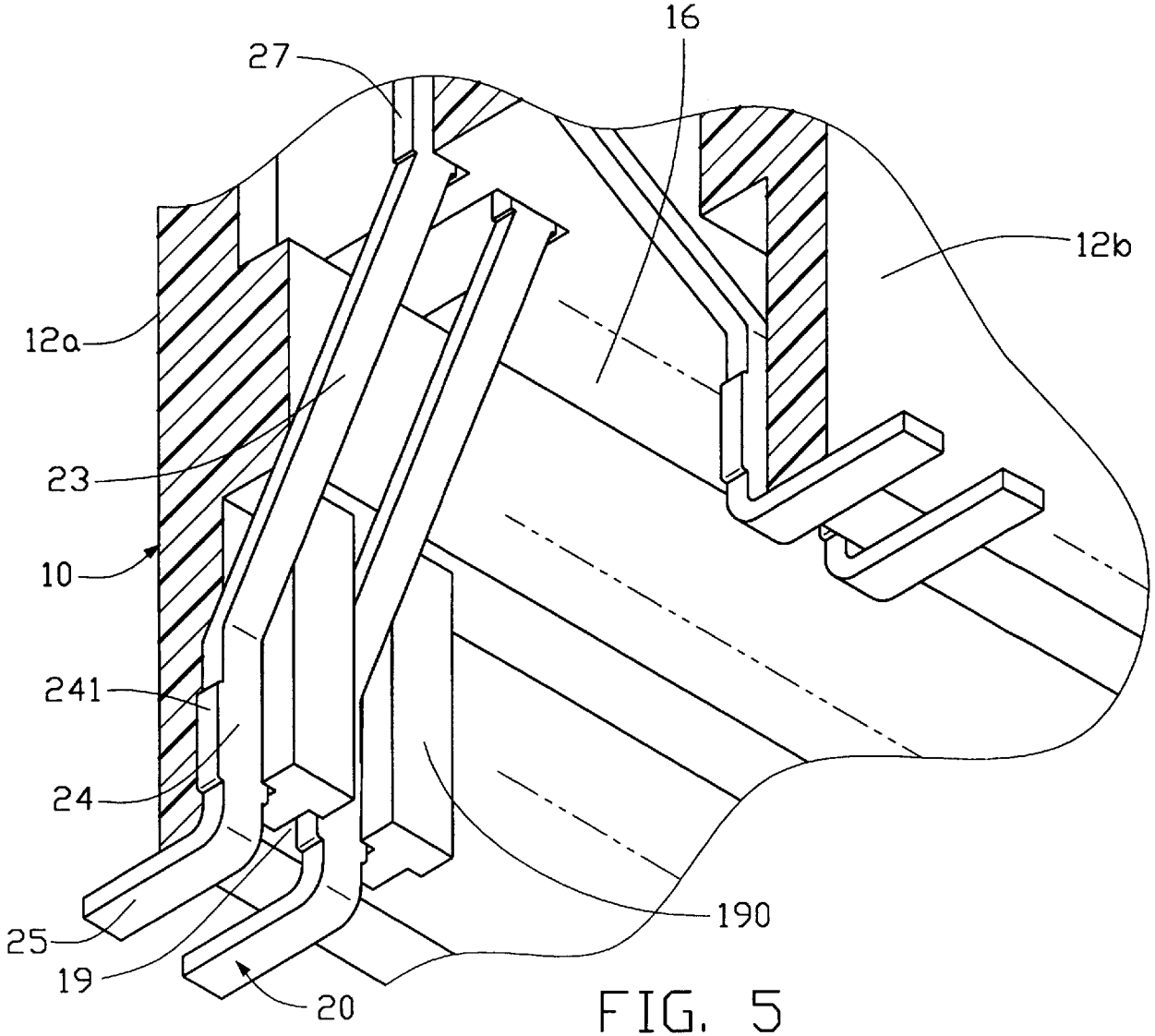
FIG. 5 is a partial, enlarged view of a lower portion of FIG. 3.

Referring to FIGS. 4 and 5, the central portion 14 defines a plurality of passageways 130 therethrough for receiving corresponding terminals 20 therein. The passageways 130 are spaced from each other by corresponding spacing boards 131. A plurality of receiving holes 132 is formed in the mating face 13 and communicates with corresponding passageways 130. A plurality of spacing blocks 190 is formed on opposite inner surfaces of the side walls 12*a*, 12*b* and expose to the receiving space 16. A plurality of T-shaped slots 19 is respectively formed between corresponding adjacent spacing blocks 190 for securing the terminals 20 therein.

Each terminal 20 comprises a fixing portion 21, a contacting portion 22, a slanting portion 23 and a tail portion 24. The contacting portion 22 is formed at the top end thereof for electrically contacting with a mating connector. Top end 26 of each contacting portion 22 is received in corresponding receiving hole 132 for providing a preload force on each terminal 20 and properly positioning each terminal 20 after assembly. Two pairs of barbs 27 are formed at opposite edges of the fixing portion 21 for engaging with the spacing boards 131 and securing the terminals 20 to the insulative housing 10. The distribution of the barbs 27 also can enhance the rigidity of the terminal 20. The slanting portion 23 slantways extends from the fixing portion 21 with an obtuse angle for enhancing resilience of the terminal and dispersing an insertion force exerted thereon. A tail portion 24 is formed at the end of the slanting portion 23 with a pair of engaging portions 241 formed at lateral edges thereof, the engaging portions 241 being securely received in the T-shaped slots 19. A soldering portion 25 of each terminal 20 is arranged at a same plane before soldering on a circuit board. Therefore, after the terminals 20 are assembled to the insulative housing 10, the soldering portions 25 of corresponding terminals 20 can be arranged with a proper planarity and the quality of soldering process is also improved. Furthermore, the T-shaped slots 19 can securely position tail portions 24 therein, and the terminals 20 can be prevented from buckling while an external force exerted on the soldering portions 25.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a circuit board, comprising:

an insulative housing having a central portion, a pair of side walls and a pair of lateral walls, a plurality of spacing boards being spacedly disposed between the central portion and the side walls, a passageway being defined between adjacent spacing boards, the central portion having a mating face defining a plurality of receiving holes in communication with corresponding passageways, a bottom of the central portion and the side walls together defining a receiving space in communication with the passageways, a plurality of spacing blocks being formed on inner surfaces of the side walls and extending into the receiving space, a slot being defined between adjacent spacing blocks; and a plurality of terminals received in the passageways, each terminal comprising a fixing portion defining a plurality of barbs on opposite edges thereof for securing to corresponding spacing boards, a contacting portion extending from one end of the fixing portion at a free end of the terminals and partially extending from the passage way into the receiving hole of the central portion, a slanting portion extending from a second end of the fixing portion in a direction opposite to the contacting portion, and a tail portion extending from the slanting portion opposite the fixing portion, secured in a corresponding slot, and adapted for soldering to a printed circuit board.

2. The electrical connector as claimed in claim 1, wherein the slanting portion slantways extends from the fixing portion with an obtuse angle for enhancing resilience of the terminal and preventing the terminal from being deformed.

3. The electrical connector as claimed in claim 1, wherein the tail portion comprises a soldering portion perpendicularly extending therefrom.

4. The electrical connector as claimed in claim 1, wherein the tail portion defines a pair of engaging portions on opposite edges thereof for being received in the slot to prevent inward buckling.

5. The electrical connector as claimed in claim 1, wherein two pairs of barbs are formed on opposite edges of the fixing portion for engaging with the securing boards and enhancing rigidity of the terminal.

6. The electrical connector as claimed in claim 1, wherein each contacting portion has a top end received in a corresponding receiving hole for providing a preload force on each terminal.

7. An electrical connector for mounting to a circuit board, comprising:

an insulative housing defining a center portion, a pair of side walls and a pair of lateral walls, two rows of passageways being defined between the center portion and said pair of side walls, a bottom of the center portion and the side walls together defining a receiving space, a purality of T-shaped slots being defined in an interior face of each of said pair of side walls and being in communication with the receiving space, a lateral dimension of an upper portion of the housing being smaller than that of a lower portion thereof; and a plurality of terminals received within the passageways, each of said terminals defining a vertical fixing portion abutting against the center portion and defining a plurality of barbs thereon for securing the terminal in a corresponding passageway, a contact portion extending curvilinearly upwardly from an upper end of the fixing portion, a vertical tail portion received within a corresponding T-shaped slot and adapted for soldering to the printed circuit board, and a slanting portion positioned in said receiving space and connected between a bottom end of the fixing portion and a top end of the tail portion.

8. The connector as claimed in claim 7, wherein the fixing portion is much longer than the tail portion within the T-shaped slot.

9. The connector as claimed in claim 7, wherein said slanting portion is much larger than the tail portion within the T-shaped slot.

* * * * *